United States Patent [19]

Esser et al.

[11] 4,449,773

[45] May 22, 1984

[54] LOW INSERTION FORCE CONNECTOR

[75] Inventors: Wilhelm C. J. Esser, Tilburg; Adrianus van den Nosterum, Boxtel, both of Netherlands

[73] Assignee: AMP Incorporated, Harrisburg, Pa.

[21] Appl. No.: 376,067

[22] Filed: May 7, 1982

[51] Int. Cl.[3] ..... H01R 13/62

[52] U.S. Cl. ..... 339/59 M; 339/74 R; 339/176 MF

[58] Field of Search ..... 339/74 R, 75 M, 75 MP, 339/176 MP, 176 MF, 17 F, 59 M

[56] References Cited

U.S. PATENT DOCUMENTS 3,989,336 11/1976 Rizzio, Jr. et al. ..... 339/74 R
4,327,955 5/1982 Minter ..... 339/74 R
4,379,608 4/1983 Olsson et al. ..... 339/176 MF

FOREIGN PATENT DOCUMENTS 54-98986 4/1979 Japan ..... 339/74 R

*Primary Examiner*—John McQuade
*Attorney, Agent, or Firm*—F. W. Raring

[57] ABSTRACT

A connector housing (1) has a row of cavities (4) bordering a slot (2) for receipt of a flat cable. Contacts (3) are mounted in the cavities with rearwardly inclined contact springs (7) penetrating the slot (2). An integrally hinged flap (11) on the housing is of L-section, with one limb (14) bordering the slot (2) and providing a cam surface (15) engaging the contact spring (7). Manual depression of the flap (11) deflects the contact spring (7) out of the slot (2) to permit low force insertion of the cable.

4 Claims, 3 Drawing Figures

FIG.1.
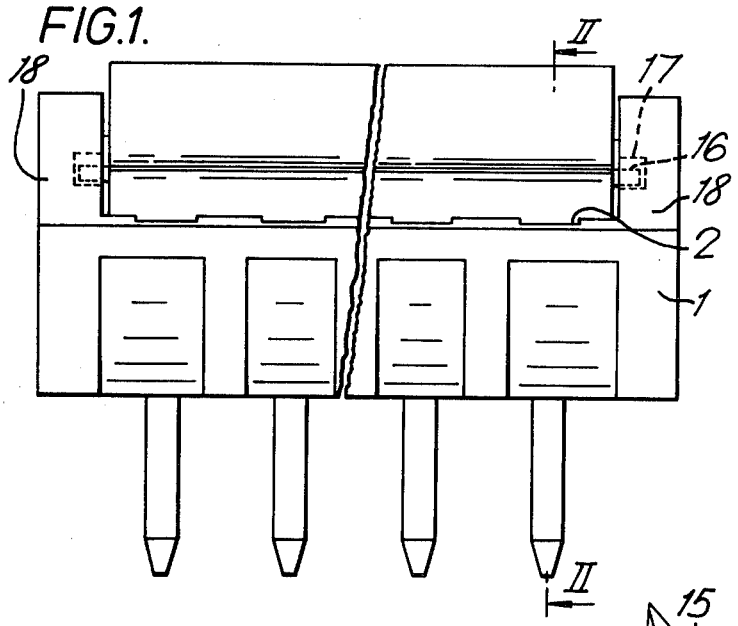
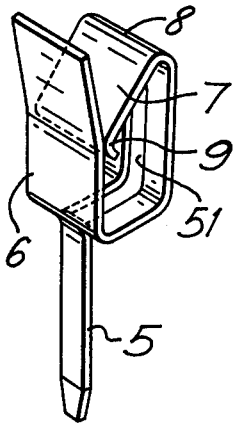
FIG.3.
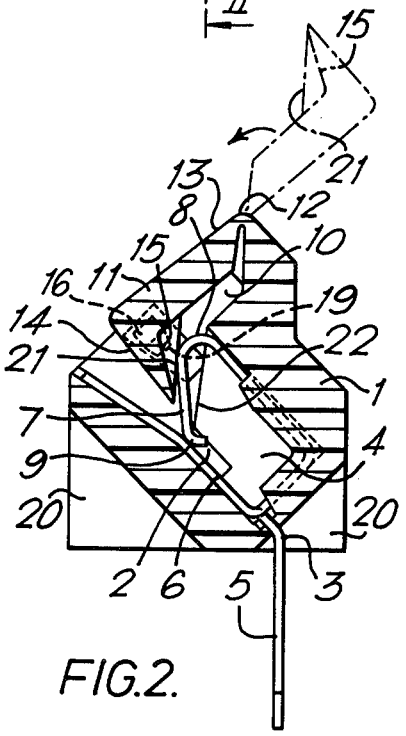
FIG.2.

LOW INSERTION FORCE CONNECTOR

This invention relates to a connector adapted for low insertion forces so that a conductor may be connected to or released from the connector with minimal risk of damage.

It is known to provide so called zero or low insertion force connectors having this facility, but generally these comprise complex structures having several relatively moveable parts including cams or wedges and which are intrinisically expensive to produce.

It is an object of the invention to provide a connector of this kind which is of simple structure and economic to produce.

According to the invention, a connector adapted for low insertion or withdrawal forces on a conductor comprises a contact mounted in an insulating housing having a passageway for receipt of the conductor, the contact having a spring finger presenting a contact portion projecting into the passageway and, forwardly of the contact portion, a forward portion extending in forwardly and outwardly inclined manner from the passageway into a cavity at a side thereof and having a housing part bordering the side of the passageway and moveably mounted on the housing adjacent the forward end of the passageway, the housing part being moveable into the cavity to engage the forward contact portion at a surface of the housing part facing away from the passageway to flex the spring finger and move the contact portion outwardly of the passageway.

Suitably the housing part is integrally formed with the housing at a hinge having an axis extending normally transversely of the passageway and spaced therefrom to allow hinge movement of the housing part into the cavity.

The housing part is suitably secured in the cavity by interengaging resilient latch means which may comprise projections and complementary recesses, the recesses being elongated lengthwise of the passageway to accommodate the desired movement.

The contact is suitably formed from sheet metal and comprises on a side of the passageway opposite the spring finger a tongue for receipt of the conductor between the tongue and the contact portion of the spring finger.

The invention will now be described by way of example with reference to the accompanying partly diagrammatic drawings in which:

FIG. 1 is a side elevation of a connector;

FIG. 2 is a section taken on the line II—II of FIG. 1, and

FIG. 3 is a perspective view of a contact of the connector.

The connector of FIGS. 1 and 2 comprises an insulating housing 1 formed with a transverse slot 2 defining a passageway for the receipt of flat cable, not shown, having a plurality of parallel conductors. A plurality of contacts 3 are mounted in the housing 1, each contact 3 being mounted in a respective cavity 4 communicating with the slot 2 and extending transversely from the slot at one side as seen in FIG. 2.

The contacts 3, FIG. 3, are stamped and formed from sheet metal and each comprises a post portion 5 projecting through an aperture in the housing for connection to a printed circuit board. Within the cavities 4, each contact has a tab portion 6 bordering the slot 2 on a side opposite that from which the cavities extend and a spring finger 7 on the opposite side. The spring finger extends from the post portion 5 transversely across the floor of the associated cavity as a base portion, then forwardly in parallel spaced relation to the tab portion to a forward bight portion 8 at which it is bent rearwardly to extend in inclined manner towards the tab portion 6 and the slot 2 where it is formed with a further bight 9 defining a contact portion projecting into the slot 2 and convex towards the tab portion 6. The post portion is suitably formed from a slot 51 extending across the base portion and forwardly in the forwardly extending portion but terminating short of the bight 8.

On the side opposite the spring finger 7 the slot 2, forwardly of the contact portion 9, is suitably inclined forwardly and outwardly to facilitate entry of a conductor into the slot, and the tab portions 6 are bent to conform to the slot side.

The cavities 4 adjacent the bights 8 of the contacts communicate with a common cavity 10 extending from the slot 2, and open at the conductor entry side of the housing 1. The housing 1 is integrally formed with a flap member 11 secured to the housing by a hinge portion 12 and adapted to close the open side of the cavity 10. The flap member 11 is suitably moulded in the broken-line position, but, after insertion of the contacts 3 into the housing, is hingedly moved into the full-line position. The flap member 11, as seen in FIG. 2, is of generally L-shaped section, having a first limb 13 adapted to form a side of the slot 2 forwards of the contact portion 8.

A cam surface 15 extends between the limbs 13, 14 in inclined manner to engage the spring fingers 7 adjacent the bights 8 before the hinge 12 is fully closed. At opposite ends the flap member 11 is formed with spigot-like projections 16 engageable in recesses 17 formed internally of end wall portions 18 of the housing. The recesses 17 are elongated in a direction parallel to the slot and the spigots 16 are suitably engageable in the recesses 17 in a snap fit by resilient outward flexure of the end wall portions 18 to retain the flap member 11 in the closed, full-line position against resilience of the hinge 12. To this end the spigots 16 are suitably chamfered at 19.

For convenience of cable lead out either parallel to or normally from a printed circuit board, the housing 1 is so formed with flanges 20 as to enable mounting on a printed circuit board with the slot 2 inclined relative to the board and the posts 5 at 45 degrees.

In use, to connect a flat cable, not shown, having exposed conductive foils, the flap member 11 is depressed, manually, to flex the spring fingers 7 and displace the contact portions 9 away from the tab portions 6, and out of the slot 2, to admit the cable end with minimal insertion resistance. Inclined stop surfaces 21 on the flap are suitably arranged to engage complementary abutments 22 within the housing to limit closure of the flap member 11 and protect against overstress of the spring fingers 7. The flap member 11 is then released to resile under the influence of hinge 12 and of the spring fingers 7, the contact portions 9 being urged against conductive portions of the cable.

The reverse procedure may be followed for release of the cable from the connector with minmal withdrawal forces.

It will be understood that damage to the cable during insertion and withdrawal is avoided by the simple structural features of the connector assembly.

The particular connector disclosed is intended for use with flat conductors but is usable with discrete wires, in which case the tab portion 6 would be suitably serrated on its inner face.

What is claimed is:

1. An electrical connector adapted for low insertion or withdrawal forces on a conductor and comprising a sheet metal contact mounted in an insulating housing having a passageway for receipt of the conductor, the contact having a spring finger presenting a contact portion projecting into the passageway and, forwardly of the contact portion, a forward portion extending in forwardly and outwardly inclined manner from the passageway into a cavity, which is in the housing, at a side thereof and having a housing part bordering a side of the passageway at the side of the cavity and moveably mounted on the housing adjacent the forward end of the passageway, the housing part being moveable into the cavity to engage the forward contact portion at a surface of the housing part facing away from the passageway to flex the spring finger and move the contact portion outwardly of the passageway, the housing part being connected to the housing by an integral hinge which extends beside, and parallel to, the passageway, the hinge being spaced from the passageway to allow the housing part to move along an arcuate path into the cavity.

2. An electrical connector as claimed in claim 1, in which the housing part comprises a flap of L-section hingedly formed with the housing at the end of one limb of the L-section and with the other limb extending rearwardly into the cavity and forming a side of the passageway.

3. An electrical connector as claimed in claim 2, in which the housing part is formed between the limbs of the L-section with a contact engaging surface extending in inclined manner rearwardly towards the passageway.

4. An electrical connector as claimed in claim 1, in which the housing part is secured in the cavity by interengaging resilient latch means comprising projections and complementary recesses, the recesses being elongated lengthwise of the passageway to accommodate the desired movement.

* * * * *